US005858293A

United States Patent [19]

Yoo

[11] Patent Number: 5,858,293

[45] Date of Patent: Jan. 12, 1999

[54] METHOD FOR PRODUCING SPUNBONDED MATERIALS WITH IMPROVED TENSILE STRENGTH

[75] Inventor: Hee Ju Yoo, Seoul, Rep. of Korea

[73] Assignee: Montell North America Inc., Wilmington, Del.

[21] Appl. No.: 940,719

[22] Filed: Sep. 30, 1997

[51] Int. Cl.[6] ..... B29C 47/60

[52] U.S. Cl. ..... 264/211.22; 264/177.13; 264/211.12; 264/211.18; 264/211.21; 264/209.3; 264/209.5; 264/176.1

[58] Field of Search ..... 428/364; 524/436, 524/437, 357, 182, 181, 366, 354; 264/176.1, 177.13, 209.3, 209.5, 211.12, 211.14, 211.15, 211.17, 211.18, 211.21, 211.22

[56] References Cited

U.S. PATENT DOCUMENTS 4,299,759 11/1981 Miyata et al. .
4,611,024 9/1986 Wolfe .
4,965,301 10/1990 Leininger .
5,106,898 4/1992 Nosu et al. .
5,246,777 9/1993 Ishii et al. .
5,252,645 10/1993 Nosu et al. .
5,352,723 10/1994 Tanno et al. .
5,484,583 1/1996 Grubbs et al. .

*Primary Examiner*—Merrick Dixon

[57] ABSTRACT

A spunbonded material having improved tensile strength is made by (1) continuously extruding a propylene homopolymer or random propylene/ethylene copolymer having a melt flow rate of about 3 to about 30 g/10 min at a temperature above 500° F. through a spinneret to form discrete filaments, (2) drawing the filaments to molecularly orient the polymer filaments, and (3) depositing the filaments in a substantially random manner onto a carrier belt to form a web. The propylene polymer contains an additives package that includes an organic phosphite, a hindered phenol compound, calcium stearate, and, optionally, a hydrotalcite compound.

3 Claims, 2 Drawing Sheets

METHOD FOR PRODUCING SPUNBONDED MATERIALS WITH IMPROVED TENSILE STRENGTH

FIELD OF THE INVENTION

This invention relates to a method for making spunbonded materials from propylene polymer materials.

BACKGROUND OF THE INVENTION

Polypropylene resins are used to make nonwoven fabrics for applications such as diaper liners, medical gowns, and oil absorbents. One of the most important properties of these materials is their strength. For making conventional spunbonded materials, relatively high melt flow rate (MFR) resins (lower viscosity or lower molecular weight) are used at relatively low spinning temperatures, even though lower MFR (higher viscosity or higher molecular weight) resins give greater fabric strength. If a low MFR resin is employed, it cannot be processed at a normal spinning temperature because too many spin breaks occur. Spunbond fiber resins currently used have a MFR of about 40 and adequate spin continuity is maintained at a spinning temperature of about 210° C.

Various combinations of stabilizers have been used to prevent thermal degradation of polyolefins, as well as to increase resistance to degradation by light and to improve processability. Japanese published application 61-133251 discloses a heat resistant polyolefin resin molding composition containing a combination of a phenolic antioxidant, an organic phosphite, and hydrotalcite. U.S. Pat. No. 4, 611,024 discloses an injection molding grade resin that can also be used for making fibers and films. The resin contains an acetal clarifying agent and hydrotalcite. Optional ingredients include a phenolic antioxidant, an organic phosphite and a metal soap such as calcium stearate. U.S. Pat No. 4,965,301 discloses a stabilizer package for polyolefin fibers comprising (a) at least one hindered phenol, (b) at least one organic phosphite, (c) at least one hindered amine, (d) at least one metal salt of a long chain fatty acid, and (e) an alkali metal phosphate. U.S. Pat. No. 5,246,777 discloses a fiber-forming polyolefin composition stabilized against heat, oxidation, light, and discoloration by combustion gases. The stabilizers include a hindered phenol, a hindered piperidine compound, and, optionally, an organic phosphorus compound antioxidant. Thus there is a need for a combination of additives that will provide spunbonded materials with increased tensile strength.

SUMMARY OF THE INVENTION

The process of this invention for making a spunbonded material comprises:

(a) continuously extruding a propylene polymer material selected from the group consisting of (i) a propylene homopolymer and (ii) a random copolymer of propylene and ethylene having an ethylene content of less than 10% by weight, having a melt flow rate of about 3 to about 30 g/10 min through a spinneret at a temperature greater than 500° F. to form discrete filaments, (b) drawing the filaments to molecularly orient the polymer filaments, and (c) depositing the filaments in a substantially random manner onto a carrier belt to form a web, wherein the propylene polymer material contains additives consisting essentially of:

(i) about 250 parts to about 2500 parts of a pentaerythritol diphosphite, (ii) about 250 parts to about 2500 parts of a hindered phenol compound, (iii) about 100 parts to about 1500 parts of calcium stearate, and, optionally, (iv) about 5 to about 500 parts of a hydrotalcite compound, all parts being per million parts of the propylene polymer material.

The spunbonded material made by the process of this invention has improved tensile strength compared to conventional spunbonded materials while using a lower MFR resin.

DETAILED DESCRIPTION OF THE INVENTION

Figure 1:
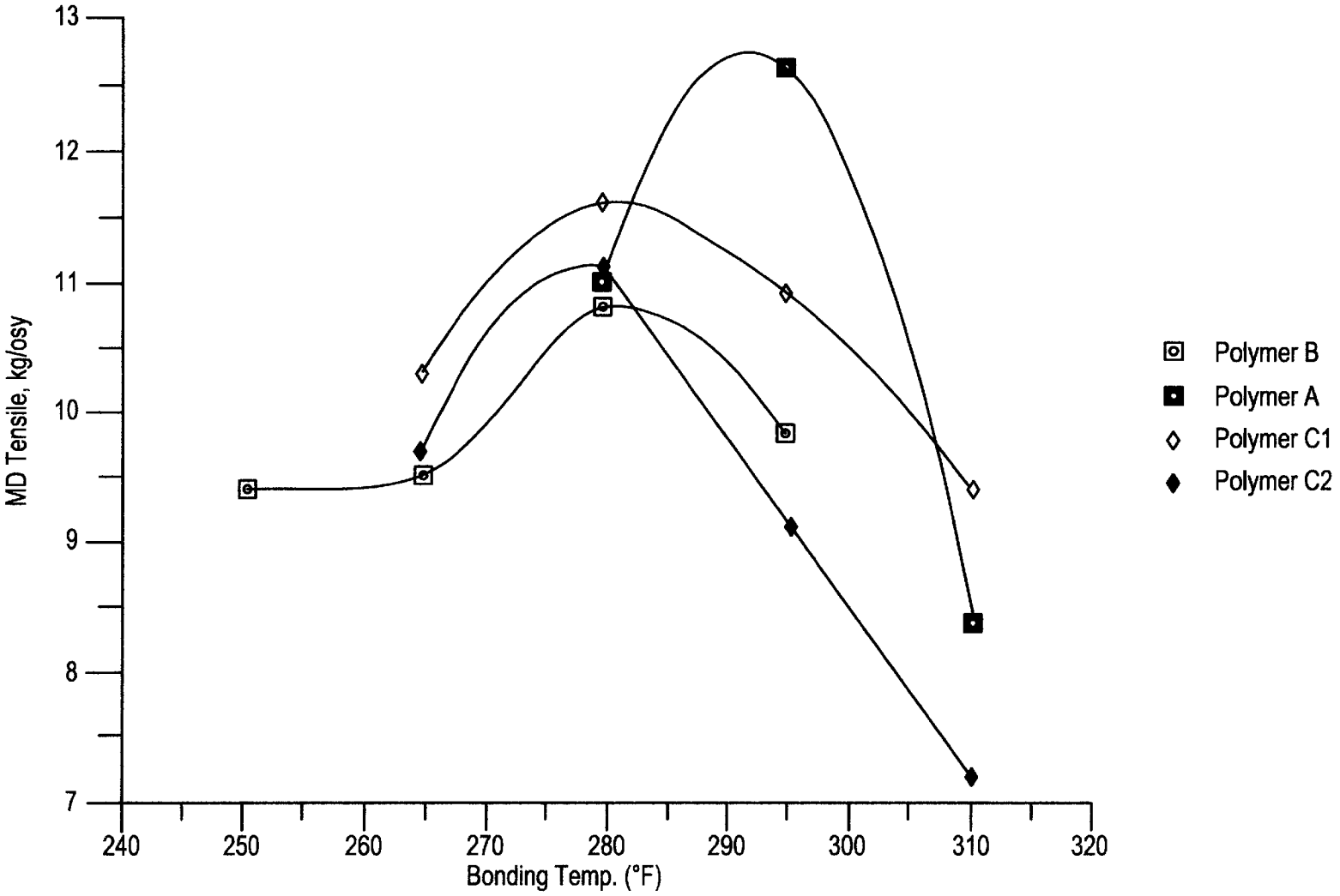
FIG. 1 is a plot of MD tensile strength (kg/osy) vs bonding temperature (°F) for materials made according to the process of this invention, compared with those made under conventional spunbonding conditions, and those made using the polymer and the spinning temperature of the process of this invention but having a less effective combination of additives. Osy=ounces per square yard.

The propylene homopolymer or random propylene/ethylene copolymer used in the process of this invention has a melt flow rate (MFR) of about 3 to about 30 g/10 min (ASTM D-1238, 2.16 kg at 230° C.), preferably about 3 to about 25 g/10 min and most preferably about 3 to about 20 g/10 min. The copolymer preferably has an ethylene content of less than 10% ethylene.

Propylene polymer materials having a MFR within this range can be obtained by visbreaking a polymer having a lower MFR, i.e., subjecting the polymer to chain scission. This process not only lowers the molecular weight and raises the melt flow rate of the polymers, but it also leads to a narrowing of the molecular weight distribution. Generally speaking, higher molecular weight leads to better physical properties but poorer processing properties. Conversely, lower molecular weight leads to poorer physical properties, but better processing properties. A low molecular weight polymer with narrow molecular weight distribution gives both good physical and processing properties in many fabricated articles. Therefore it is a common procedure to polymerize propylene, or propylene and ethylene, to a higher molecular weight than desired for the final application, and then to visbreak to the desired molecular weight.

In commercial practice visbreaking is generally achieved by the addition of a prodegradant to the polymer before pelletization. Alternatively, the polymer and the prodegradant can be mixed in the extruder while heating. A prodegradant is a substance that promotes chain scission when mixed with the polymer, which is then heated under extrusion conditions. The prodegradants used in current commercial practice are mainly alkyl hydroperoxides or dialkyl peroxides. These materials initiate a free radical chain reaction at elevated temperatures, resulting in scission of the propylene polymer molecules.

In order to overcome the spinning problem inherent in the use of a resin with a relatively low MFR, higher spinning temperatures are used so that the melt viscosity of the polymer at the spinneret die can be maintained at the same value as a higher MFR resin at a normal spinning temperature. For example, the melt viscosity of a 10 MFR resin at a melt temperature of 536° F. is the same as that of a 38 MFR resin at a melt temperature of 410° F. Therefore the spinnability of these two resins (10 and 38 MFR) will be the same at the respective spinning temperatures. In the process of this invention the propylene polymer is spun at a temperature of greater than 500° F. (260° C.), preferably greater than 525° F. (274° C.).

Since higher than normal spinning temperatures are used during the process of this invention, an additive package is needed that provides strong stabilization against thermal degradation of the propylene polymer, which leads to poor fabric strength. The additives package of this invention consists essentially of (a) a pentaerythritol diphosphite, (b) a hindered phenol compound, and (c) calcium stearate. Optionally component (a) can be mixed with a hydrotalcite compound, e.g., it can be added as a product such as Ultranox 627A bis(2,4-di-t-butylphenyl)pentaerythritol diphosphite, which contains 7% DHT-4A hydrotalcite compound having the formula $[Mg_{4-5}Al_2(OH)_{13}CO_3 \cdot 3.5H_2O]$. Ultranox 627A stabilizer is commercially available from GE Specialty Chemicals. The hydrotalcite compound is not necessary for thermal stabilization, but increases the hydrolytic stability of the pentaerythritol diphosphite, making it easier to handle.

The pentaerythritol diphosphite can be selected from compounds having the formula

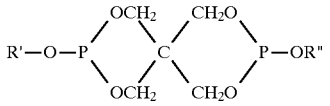

in which R' and R" are the same or different and are selected from $C_{1-20}$ linear or branched alkyl, $C_{5-20}$ cycloalkyl, $C_{6-20}$ aryl, and $C_{2-20}$ alkoxyalkyl groups, and the halo-substituted derivatives thereof, as well as combinations such as alkaryl containing up to 20 carbon atoms per molecule. Preferably, R' and R" are the same and are alkaryl, most preferably alkylphenyl.

Specific examples of suitable pentaerythritol diphosphites include dimethylpentaerythritol diphosphite, diethylpentaerythritol diphosphite, didodecylpentaerythritol diphosphite, ditolylpentaerythritol diphosphite, distearyl pentaerythritol diphosphite, diphenyl pentaerythritol diphosphite, dibenzyl pentaerythritol diphosphite, bis(2,4-di-t-butylphenyl) pentaerythritol diphosphite, and di-p-chlorophenyl pentaerythritol diphosphite. Other suitable organic phosphite compounds having this formula are disclosed in U.S. Pat. No. 4,025,486, which is incorporated herein by reference. Bis(2,4-di-t-butylphenyl) pentaerythritol diphosphite is preferred.

The pentaerythritol diphosphite is present in an amount of about 250 to about 2500 parts per million parts of the propylene polymer material, preferably about 745 parts to about 1115 parts, and most preferably about 835 to about 1025 parts.

Hydrotalcite $[Mg_6Al_2(OH)_{16}CO_3 \cdot 4H_2O]$ occurs naturally in small deposits in the former Soviet Union and also in Snarum, Norway. It can also be produced synthetically. The DHT-4A product having the formula $[Mg_{4-5}Al_2(OH)_{13}CO_3 \cdot 3.5H_2O]$ is a hydrotalcite-like compound that is available commercially from Kyowa Chemical Industry Co., Ltd. When present, the hydrotalcite compound is used in amount of about 5 parts to about 500 parts per million parts of the propylene polymer material, preferably about 55 parts to about 85 parts, and most preferably about 60 to about 80 parts.

Suitable hindered phenol compounds include, for example, tetrakis[methylene(3,5-di-t-butyl-4-hydroxyhydrocinnamate)methane; 1,3,5-trimethyl-2,4,6-tris(3,5-di-t-butyl-4-hydroxybenzyl)benzene; 1,3,5-tris(4-tert-butyl-3-hydroxy-2,6-dimethylbenzyl)-1,3,5-triazine-2,4,6-(1H, 3H, 5H)-trione; 3,9-bis[2-{3-(3-t-butyl-4hydroxy-5-methylphenyl)propionyloxy }-1,1 -dimethylethyl]-2,4,8,10-tetraoxaspiro[5.5] undecane, and 1,3,5-tris(3,5-di-tert-butyl-4-hydroxybenzyl)- 1,3,5-triazine-2,4,6(1H, 3H, 5H)-trione. 1,3,5-Trimethyl-2,4,6-tris(3,5-di-t-butyl-4-hydroxybenzyl) benzene is preferred.

The hindered phenol compound is present in an amount of about 250 parts to about 2500 parts, preferably about 800 parts to about 1200 parts, and most preferably about 900 to about 1100 parts per million parts of the propylene polymer material.

The calcium stearate is present in an amount of about 100 parts to about 1500 parts, preferably about 240 parts to about 360 parts, and most preferably about 270 to about 330 parts per million parts of the propylene polymer material.

In order to obtain spunbonded materials with the high tensile strength of this invention it is necessary to use the combination of (1) a propylene polymer material having the specified melt flow rate, (2) the specified spinning temperature, and (3) the specified combination of additives.

The combination of additives can be incorporated into the propylene polymer material in any conventional manner, such as by dry blending the additives directly with polymer pellets or fluff, by means of, for example, tumble mixers and Henschel blenders, as is known in the art. Solutions or slurries of the additives can be sprayed onto or admixed with granular polymer. The additives can also be blended with molten polymer by means of, for example, a Banbury mixer, Brabender mixer, roll mil, or screw extruder.

A convenient method is to add the additives in dry form to granulated propylene polymer material, followed by extruding to provide a pelletized product that subsequently can be used for forming fibers. Other additives such as, for example, fillers, extenders, plasticizers, coloring agents, and other polymeric materials can be added to the propylene polymer material.

Spunbonded materials are prepared by continuously extruding the polymer through a spinneret to form discrete filaments. Thereafter, the filaments are drawn either mechanically or pneumatically without breaking in order to molecularly orient the polymer filaments and achieve tenacity. The continuous filaments are then deposited in a substantially random manner onto a carrier belt to form a web.

In Example 1 and Comparative Examples 1–3, the fibers and nonwoven materials were prepared on a 1 meter wide Reicofil pilot laboratory spunbond line under the conditions specified in Table 1. Polymer B (Comparative Example 1), was spun under the current standard conditions used for making polypropylene spunbonded materials, i.e., a spinning temperature of 410° F. (210° C.). Polymers A, C1, and C2 were spun at 536° F. (280° C.).

The grab tensile strength of the spunbonded materials was measured using ASTM-D 1682 and ASTM-D 1776.

Melt flow rates were measured according to ASTM D-1238 (2.16 kg, 230° C.).

In this specification, all parts and percentages are by weight unless otherwise noted.

Example 1 and Comparative Examples 1–3

Figure 2:
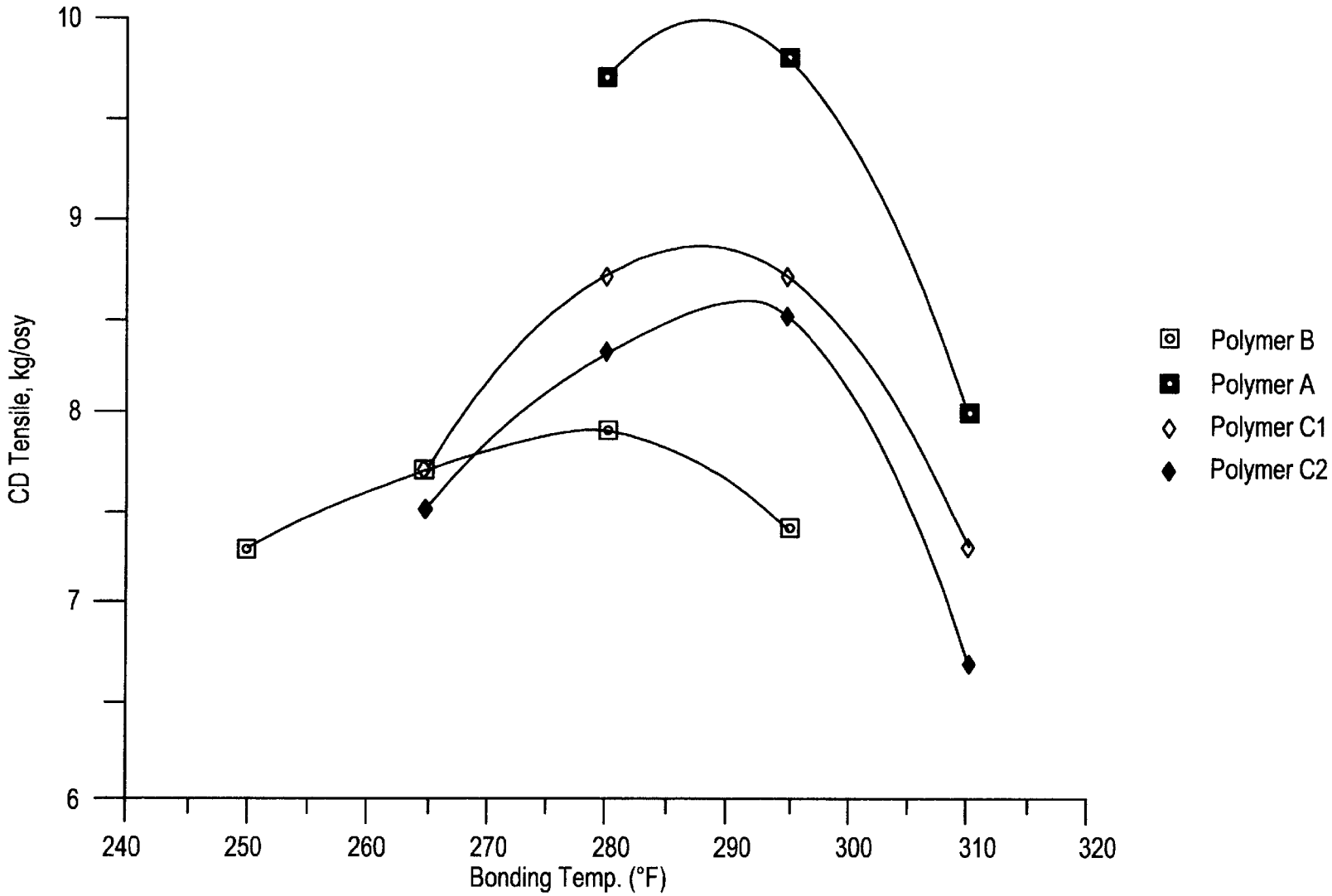
FIG. 2 is a plot of CD tensile strength (kg/osy) vs bonding temperature (°F.) for materials made according to the process of this invention, compared with those made under conventional spunbonding conditions, and those made using the polymer and the spinning temperature of the process of this invention but having a less effective combination of additives.

FIGS. 1 and 2 show the dramatic increase in tensile strength in a spunbonded material made by the process of this invention (Polymer A) compared to those made from a standard spunbond resin spun under standard conditions (Polymer B, Comparative Example 1) and those made using the spinning temperature and a polymer having the melt flow rate specified by the process of this invention, but without the specified combination of additives (Polymers C1 and C2, Comparative Examples 2 and 3). The spinning conditions are indicated in Table 1. In the figures, osy=oz/yd$^2$.

In Table 1 and in FIGS. 1 and 2, Polymer A was a propylene homopolymer having a MFR of 10 g/10 min. The polymer was prepared by visbreaking a propylene homopolymer having a MFR of 1 g/10 min. The additives used in Example 1 were a combination of (a) 1000 ppm Ethanox 330 1,3,5-trimethyl-2,4,6-tris(3,5-di-tert-butyl-4-hydroxybenzyl)benzene, commercially available from Albemarle Corporation; (b) 1000 ppm Ultranox 627A bis(2,4di-t-butylphenyl)pentaerythritol diphosphite containing 7% DHT-4A hydrotalcite compound, commercially available from GE Specialty Chemicals, and (c) 300 ppm calcium stearate.

Polymer B was a standard spunbond resin having a MFR of 38 g/10 min, commercially available from Montell USA Inc., which was prepared by visbreaking a propylene homopolymer in flake form having a MFR of 0.4 g/10 min. The polymer contained 1000 ppm Irganox 1076 octadecyl 3,5-di-tert-butyl-4-hydroxyhydrocinnamate antioxidant, commercially available from CIBA Specialty Chemicals Corporation, and 300 ppm calcium stearate.

Polymers C1 and C2 were the same propylene homopolymer as Polymer A, but contained a less effective combination of additives consisting of (a) 1000 ppm Irganox 1076 antioxidant, and (b) 300 ppm calcium stearate.

TABLE 1

| | Polymer | Melt Temp. (°F.) | Throughput (g/hole/min) | Cooling Air Temp. (°F.) | Suction (rpm) | Fiber Size (microns) |
|---|---|---|---|---|---|---|
| Example 1 | A | 536 | 0.35 | 50 | 2500 | 26 |
| Comp. Ex. 1 | B | 410 | 0.35 | 50 | 2500 | 26 |
| Comp. Ex. 2 | C1 | 536 | 0.35 | 50 | 2500 | 25 |
| Comp. Ex. 3 | C2 | 536 | 0.35 | 50 | 2200 | 26 |

The data plotted in FIGS. 1 and 2 show that when the 10 MFR polymer containing the combination of additives specified in the process of this invention (Polymer A) was processed at a higher temperature to produce the same fiber size as that made from the standard spunbond resin (Polymer B), it produced a fabric that had a significantly higher grab tensile strength. The 10 MFR polymers containing a hindered phenol compound and calcium stearate (Polymers C1 and C2) degraded more during spinning and produced fabrics with lower grab tensile strength than those made from the same MFR polymer containing the more effective combination of additives of this invention. For the 10 MFR polymers C1 and C2, a finer fiber size was obtained for Polymer C1, which resulted in higher fabric strength compared to Polymer C2. It should be noted that the suction pressure was lowered for Polymer C2 to produce the same fiber size.

Example 2

Samples containing different combinations of additives in a propylene homopolymer (not visbroken) having a MFR of 7.3 were prepared. The components of each sample were weighed and bag blended. A ¾" compression screw with a 25:1 length:diameter ratio and a screw speed of 60 rpm were used for all extrusions. The original sample was compounded at 245° C., with subsequent passes through the extruder at the temperatures indicated in Table 2.

In Table 2 Ultranox 627A stabilizer is bis(2,4-di-t-butylphenyl)pentaerythritol diphosphite that contains 7% DHT-4A hydrotalcite compound having the formula [$Mg_{4-5}Al_2(OH)_{13}CO_3$. 3.5 $H_2O$]. Ultranox 626 is the same pentaerythritol diphosphite without the DHT. Both Ultranox stabilizers are commercially available from GE Specialty Chemicals.

The sample having the lowest MFR at the highest temperature employed was most likely to produce spunbonded materials with the highest tensile strength. The results are given in Table 2.

TABLE 2

| Sample | 1 | 2 | 3 | 4 | 5 | 6 | 7 | 8 | 9 | 10 |
|---|---|---|---|---|---|---|---|---|---|---|
| Polypropylene | 100 | 100 | 100 | 100 | 100 | 100 | 100 | 100 | 100 | 100 |
| Ultranox 627A | — | 0.1 | — | — | — | 0.1 | — | — | 0.1 | — |
| Ethanox 330 | — | — | 0.1 | — | — | 0.1 | 0.1 | 0.1 | 0.1 | 0.1 |
| Ca Stearate | — | — | — | 0.03 | — | — | — | 0.03 | 0.03 | 0.03 |
| Ultranox 626 | — | — | — | — | 0.09 | — | 0.09 | — | — | 0.1 |
| MFR (g/10 min) | | | | | | | | | | |
| Original | 7.3 | 6.2 | 5.9 | 9.1 | 6.3 | 4.7 | 4.8 | 6.5 | 4.8 | 4.7 |
| 1st Pass @260° C. | 11.5 | 7.3 | 7.0 | 19.4 | 7.2 | 5.4 | 5.6 | 11.1 | 5.6 | 5.5 |
| 1st Pass @290° C. | 20.2 | 9.0 | 8.2 | 29.2 | 8.9 | 6.1 | 6.0 | 15.2 | 6.5 | 6.6 |

A comparison of the data for samples 2 and 5, 6 and 7, and 9 and 10 shows that the hydrotalcite compound is not required for thermal stabilization.

Other features, advantages and embodiments of the invention disclosed herein will be readily apparent to those exercising ordinary skill after reading the foregoing disclosures. In this regard, while specific embodiments of the invention have been described in considerable detail, variations and modifications of these embodiments can be effected without departing from the spirit and scope of the invention as described and claimed.

I claim:

1. A process for making a spunbonded material comprising:

(a) Adding to a propylene polymer material selected from the group consisting of (i) a propylene homopolymer and (ii) a random copolymer of propylene and ethylene having an ethylene content of less than 10% by weight, having a melt flow rate of about 3 to about 30 g/10 min, additives consisting essentially of:

(i) about 250 parts to about 2500 parts of a pentaerythritol diphosphite, (ii) about 250 parts to about 2500 parts of a hindered phenol compound, (iii) about 100 parts to about 1500 parts of calcium stearate, and, optionally (iv) about 5 to about 500 parts of a hydrotalcite compound, all parts being per million parts of the propylene polymer material, (b) continuously extruding the propylene polymer material through a spinneret at a temperature greater than 500° F. to form discrete filaments, (c) drawing the filaments to molecularly orient the polymer filaments, and (d) depositing the filaments in a substantially random manner onto a carrier belt to form a web.

2. The process of claim 1, wherein the propylene polymer material has a melt flow rate of about 3 to about 20 g/10 min and is extruded at a temperature of greater than 525° F.

3. The process of claim 1, wherein (i) is present in an amount of about 745 to about 1145 part, (ii) is present in an amount of about 800 to about 1200 parts, (iii) is present in an amount of about 240 to about 360 parts, and (iv) is present in an amount of about 55 to about 85 parts.

* * * * *